United States Patent [19]

Nishimoto

[11] 4,182,210

[45] Jan. 8, 1980

[54] KEYING SYSTEM FOR AN ELECTRONIC MUSICAL INSTRUMENT

[75] Inventor: Tetsuo Nishimoto, Hamamatsu, Japan

[73] Assignee: Nippon Gakki Seizo Kabushiki Kaisha, Japan

[21] Appl. No.: 935,376

[22] Filed: Aug. 21, 1978

[30] Foreign Application Priority Data

Sep. 22, 1977 [JP] Japan ..... 52/105451

[51] Int. Cl.[2] ..... G10H 1/00; G10H 5/00

[52] U.S. Cl. ..... 84/1.01; 84/DIG. 23; 340/365 E

[58] Field of Search ..... 84/1.01, 1.13, 1.26, 84/DIG. 8, DIG. 23; 340/365 R, 365 S, 365 E

[56] References Cited

U.S. PATENT DOCUMENTS 4,030,398 6/1977 Dittmar ..... 84/1.01 X 4,117,758 10/1978 Osburn et al. ..... 84/1.01

*Primary Examiner*—S. J. Witkowski

*Attorney, Agent, or Firm*—Kane, Dalsimer, Kane, Sullivan and Kurucz

[57] ABSTRACT

A keying system for an electronic musical instrument in which the absolute value of the amplitude of a musical tone signal generated with a predetermined periodicity is detected so that gating of the musical tone signal is allowed only when the amplitude of the musical tone signal is small, thereby to prevent the occurrence of click noises accompanying the keying of the musical tone signal in correspondence to depression and release of a key in a keyboard.

8 Claims, 10 Drawing Figures

KEYING SYSTEM FOR AN ELECTRONIC MUSICAL INSTRUMENT

BACKGROUND OF THE INVENTION

This invention relates to an electronic musical instrument, and more particularly to a keying system for an electronic musical instrument for gating musical tone signals in accordance with depression and release of keys in a keyboard or keyboards.

In general, the keying systems for an electronic musical instrument are classified into a direct keying system and an indirect keying system. In the indirect keying system, an envelope generator is driven by a key-ON signal (FIG. 1) which starts at the key depression and ceases at the key release, to generate an envelope waveform (FIG. 2) which rises and falls with certain time constants and in synchronism with the key-ON signal. The envelope waveform controls the operation of a gate circuit to which musical tone signals are applied, to transmit the tone signal or signals to a sound system in accordance with the envelope waveform. On the other hand, in the direct keying system, the operation of a gate circuit is directly controlled by the key-ON signal, or musical tone signals are applied directly to mechanical key switches to perform the gating of the musical tone signals. In such direct keying system, the musical tone signal begins to be outputted with its full amplitude given at the instant that the key-ON signal rises and ceases at the fall of the key-ON signal with the full amplitude at that instant, since the key-ON signal abruptly rises and falls. As seen in FIG. 3, the amplitude of the musical tone signal is not always around a "0" level at the rise and fall of the key-ON signal. Therefore, if the gating of the musical tone signal is effected by the key-ON signal when the musical tone signal is relatively large then the waveform of the gated output is allowed to rise abruptly from the "0" level to the correspondingly high level and to fall abruptly from the high level to the "0" level as indicated by the dotted line in FIG. 3, as a result of which an unpleasant click noise is generated.

SUMMARY OF THE INVENTION

In view of the foregoing, an object of this invention is to provide a keying system for an electronic musical instrument in which generation of the above-described click noise can be positively prevented in gating a musical tone signal with a key-ON signal.

In order to achieve this object, according to this invention, a keying system comprises a circuit for generating a level detection signal when the absolute valve of the amplitude of a musical tone signal output by a musical tone signal generating circuit is lower than a predetermined value, and furthermore a gate circuit allowing the musical tone signal to pass therethrough for a period of time from the instant that the level detection signal is generated for the first time after the provision of a key-ON signal until the level detection signal is generated for the first time after the elimination of the key-ON signal, thereby to perform the gating of the musical tone signal only when the amplitude of the musical tone signal is around the "0" level.

The foregoing object and other objects as well as the characteristic features of the present invention will become more apparent from the following detailed description and the appended claims when read in conjunction with the accompanying drawings.

DETAILED DESCRIPTION OF THE INVENTION

Figure 1:
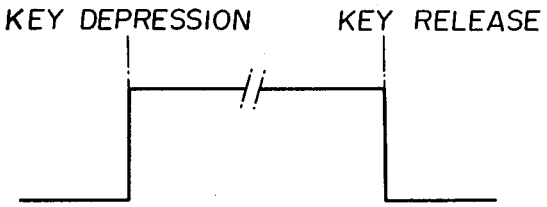
FIG. 1 is a waveform diagram for a description of a key-ON signal.
Figure 2:
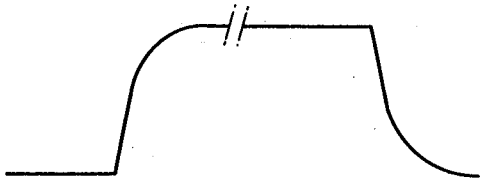
FIG. 2 is a waveform diagram showing an envelope waveform for controlling a musical tone signal in an indirect keying system.
Figure 3:
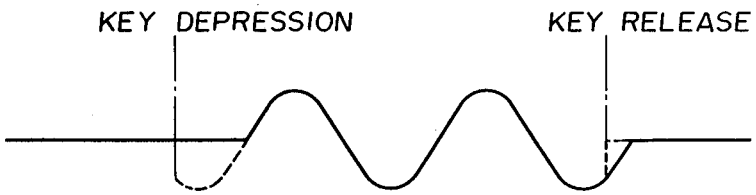
FIG. 3 is a diagram to explain a gated waveform of a musical tone signal.
Figure 4:
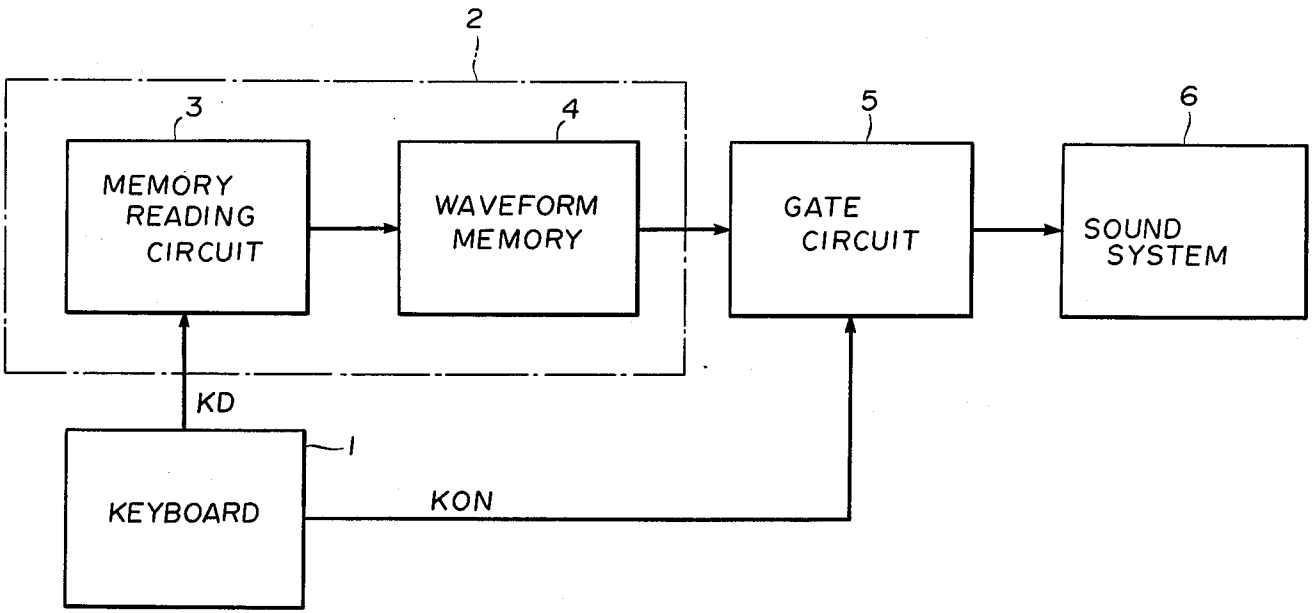
FIG. 4 is a block diagram showing one example of the entire arrangement of an electronic musical instrument to which a keying system according to this invention is applied.

One example of the entire arrangement of an electronic musical instrument employing a keying system according to this invention is illustrated in FIG. 4.

Referring to FIG. 4, key information KD representative of an operated key's tone pitch is provided by depressing one or more of keys in a keyboard 1 and a key-ON signal KON representative of a key depression period are applied to a memory reading circuit 3 in a musical tone signal generating circuit 2, and to a gate circuit 5, respectively. In the musical tone signal generating circuit 2, a waveform memory 4 is connected to the memory reading circuit 3. The memory reading circuit 3 delivers a reading address signal and a reading rate signal for the waveform memory 4 in correspondence to the key information KD. Desired musical tone waveforms (or waveform signals) are stored in the waveform memory 4 in advance.

Accordingly a musical tone waveform is read out of the waveform memory 4 in response to the key depression and is applied as a musical tone signal to the gate circuit 5. The gate circuit 5 is so designed that when the absolute value of the amplitude of a musical tone signal applied thereto becomes lower than a predetermined value (approximately a "0" level in this example) after the rise of the key-ON signal. This permits the musical tone signal to be passed to a sound system 6, and when the musical tone signal amplitude reaches approximately the "0" level after the fall of the key-ON signal, it inhibits the musical tone signal from passing therethrough. This will prevent the generation of click noises at the rise and fall of the key-ON signal. The musical tone signal passed through the gate circuit 5 is produced as a musical tone by the sound system 6.

A concrete example of the gate circuit 5 will be described with reference to FIGS. 5 and 6.

Figure 5:
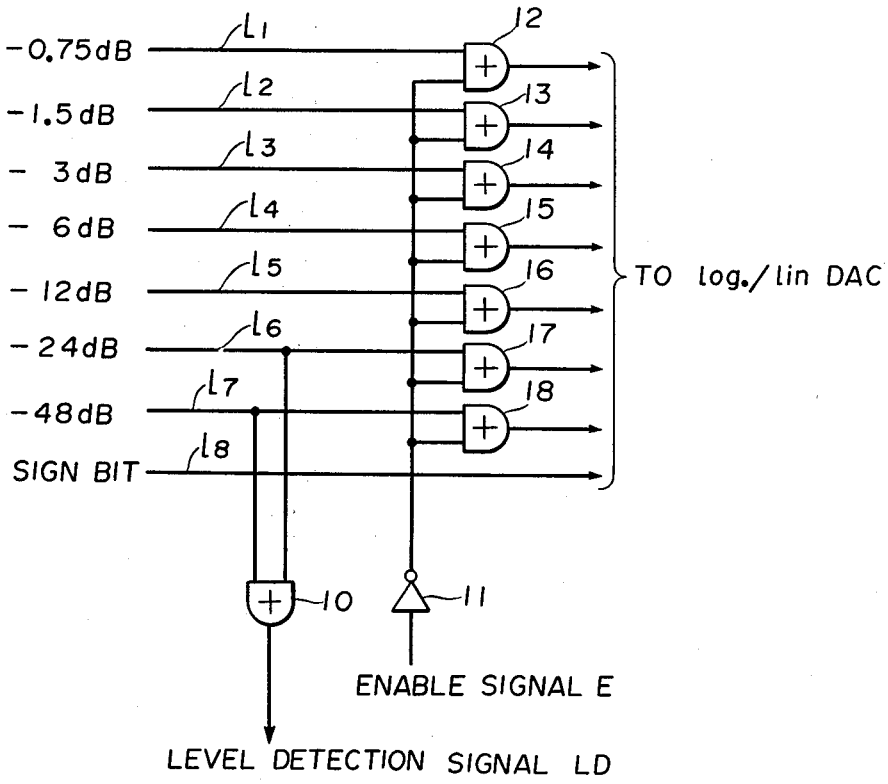
FIG. 5 is a block diagram showing one example of a gate circuit according to the invention.
Figure 7:
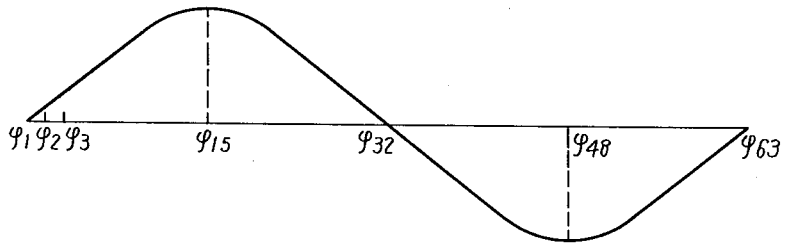
FIG. 7 is a waveform diagram showing an example of a waveform which is a musical tone signal to explain a negative logarithmic expression method.

FIG. 5 illustrates the gate circuit together with a level detection signal generating circuit adapted to control the passage of the musical tone signal. In this embodiment, an amplitude at each instant of the musical tone signal from the waveform memory 4 is expressed by a negative logarithmic value which is further expressed by binary digit notation of 8 bits using a so-called sign and magnitude expression. The respective bits corresponding to lines $l_1$ through $l_8$ connected to the output of the waveform memory 4. A peak absolute value in amplitude of the waveform of the musical tone signal is regarded as "0 dB" and the respective intermediate and minimal values in amplitude are represented by combinations of "−0.75dB", "−1.5 dB", "−3 dB", "−6 dB", "−12 dB", "−24 dB", and "−48 dB" for instance. The bits corresponding to the lines $l_1$ to $l_7$ are allotted to the above-described negative logarithmic values, respectively, wherein the bit of the line $l_1$ is the least significant bit allotted with "−0.75 dB". For instance, when a waveform signal having an amplitude of "−3 dB" is outputted by the waveform memory 4, a logical level "1" is provided to the line $l_3$, and with an amplitude of "−5.25 dB", the lines $l_1$, $l_2$ and $l_3$ have "1". If such a waveform signal as shown in FIG. 7 is delivered from the waveform memory 4, the amplitudes of the waveform at phases $\phi_0$, $\phi_1$ . . . . . $\phi_{63}$ can be expressed as indicated in Table 1.

Table 1

| Phase | $\phi_0$ | $\phi_1$ | $\phi_2$ . . . | $\phi_{15}$ . . . | $\phi_{32}$ . . . | $\phi_{48}$ . . . | $\phi_{63}$ | Line |
|---|---|---|---|---|---|---|---|---|
| LSB | 1 | 1 | 0 | 0 | 1 | 0 | 1 | $l_1$ |
| | 1 | 0 | 0 | 0 | 1 | 0 | 1 | $l_2$ |
| | 1 | 1 | 0 | 0 | 1 | 0 | 1 | $l_3$ |
| | 1 | 1 | 1 | 0 | 1 | 0 | 1 | $l_4$ |
| | 1 | 1 | 1 | 0 | 1 | 0 | 1 | $l_5$ |
| | 1 | 1 | 1 | 0 | 1 | 0 | 1 | $l_6$ |
| | 1 | 1 | 1 | 0 | 1 | 0 | 1 | $l_7$ |
| MSB | 0 | 0 | 0 | 0 | 1 | 1 | 0 | $l_8$ |

The most significant bit (MSB) in Table 1 is a sign bit corresponding to the line $l_8$ which represents whether a waveform signal applied to the lines $l_1$ through $l_8$ is positive or negative with respect to the reference level. If the waveform signal is positive, "0" is provided to the line $l_8$; while it is negative, "1" is provided. Accordingly, when all of the output signals to the lines $l_1$ through $l_8$ applied by the waveform memory 4 are at "0", the amplitude (in absolute value) of the waveform signal is maximum, while they are all at "1", the amplitude is minimum.

The lines $l_1$ through $l_8$ are connected to OR gates 12 through 18, respectively, to which an enable signal E (described later) is applied through an inverter 11. When the key-ON signal KON is outputted by the keyboard 1, the enable signal E is outputted simultaneously with or slightly later than the key-ON signal KON (cf. FIG. 8). The musical tone waveform signal outputted by the waveform memory 4 is effective only for a period of time during which the enable signal E is outputted by the waveform memory 4 is effective only for a period of time during which the enable signal E is outputted (hereinafter referred to as "an effective time" when applicable).

When no key-ON signal KON is available and the enable signal E is therefore "0", the output of the inverter 11 is "1". Accordingly, all of the outputs of the OR gates 12 through 18 are "1", and the waveform signal outputted by the waveform memory 4 becomes ineffective, i.e. inhibited by the gates 12 through 18. On the other hand, when the enable signal E is "1", the output of the inverter is "0". Accordingly, the input waveform signal is outputted, as it is, by the OR gates 12 through 18, and it is applied through a logarithmic/-linear type digital-to-analog converter (not shown) to the sound system 6.

Figure 8:
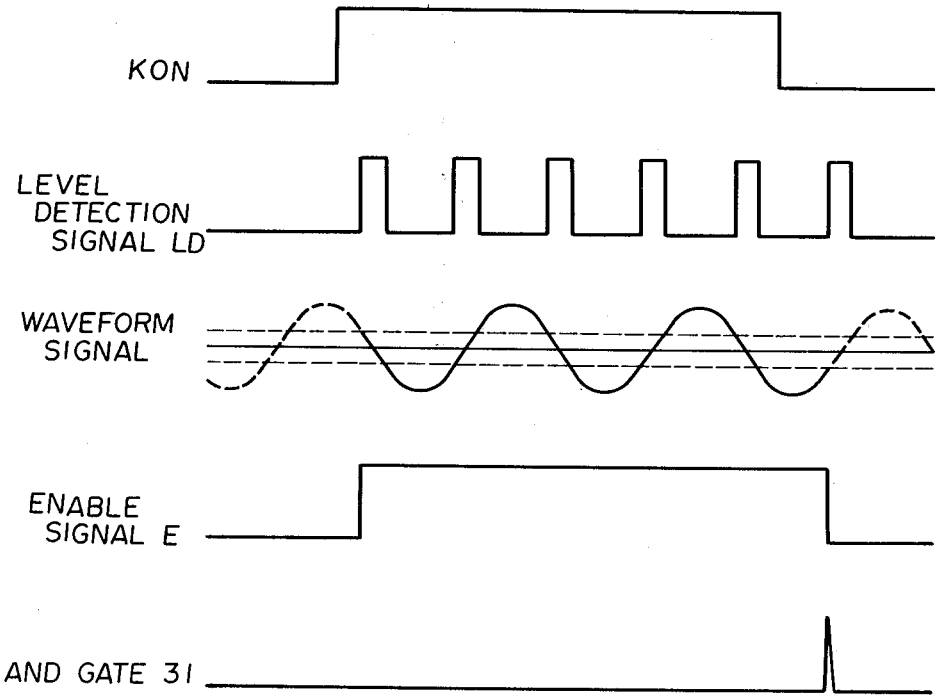
FIG. 8 is a waveform diagram for a description of the operation of the circuits shown in FIGS. 5 and 6.

In this example, the digital signals on the lines $l_6$ and $l_7$ are detected by an OR gate 10. The output signal of the OR gate 10 is used as a level detection signal LD. Accordingly, the level detection signal LD is outputted when the amplitude of the waveform signal is smaller than "−24 dB" (FIG. 8).

Figure 6:
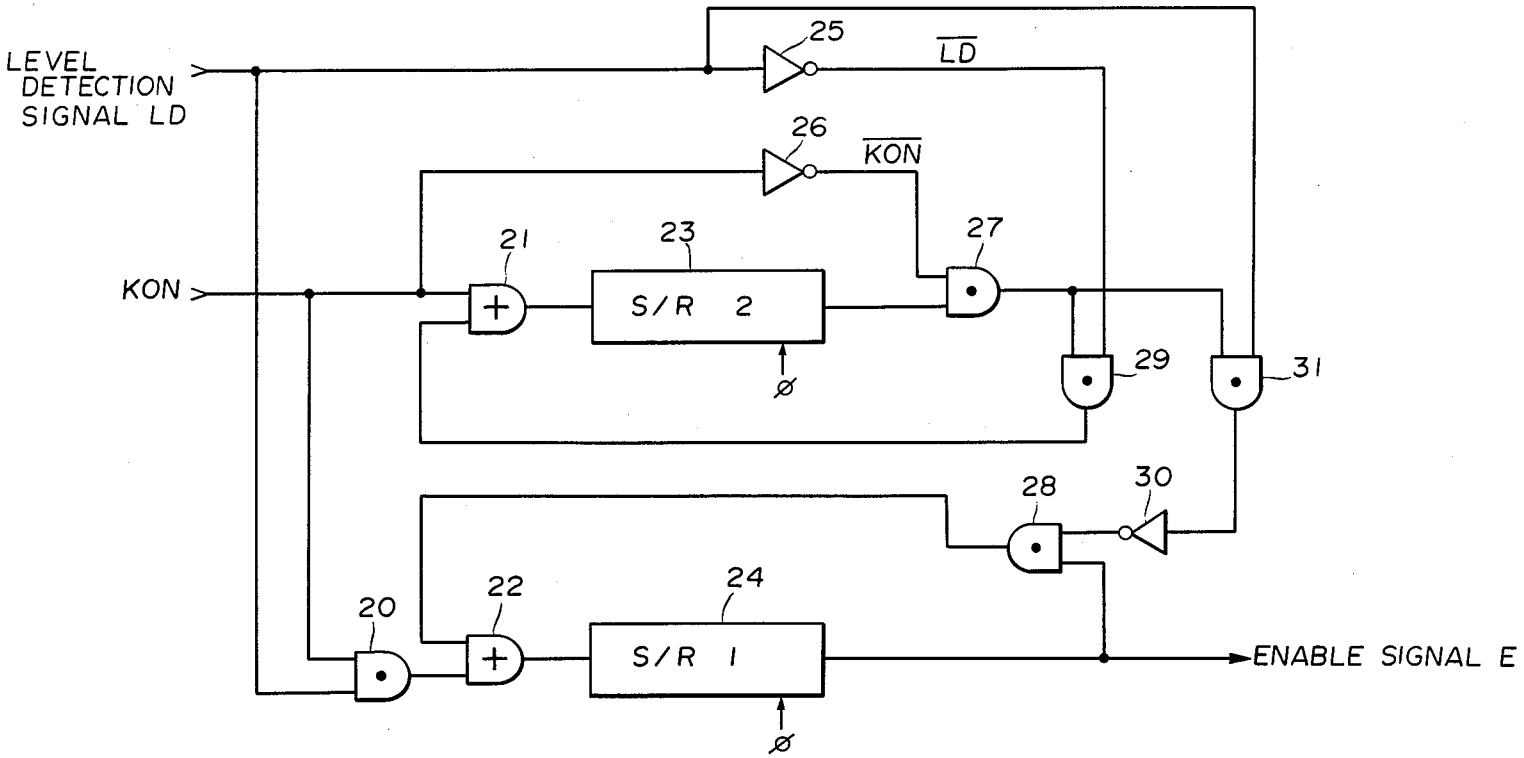
FIG. 6 is a block diagram showing an example of a gate control circuit according to the invention.

Shown in FIG. 6 is a circuit for forming the above-described enable signal E, that is, a gate control circuit for applying the waveform signal to the sound system only for the above-described effective time.

The level detection signal LD is applied to an AND gate 29 through an inverter 25, and directly to an AND gate 31. Both of the level detection signal LD and the key-ON signal KON are applied to an AND gate 20, the output of which is applied to a shift register 24 through an OR gate 22. The shift register 24 is driven by a clock pulse 0, thereby to output the above-described enable signal E. The enable signal E is introduced to an AND gate 28 which is controlled by a signal which is obtained by inverting the output signal of the AND gate 31 by an inverter 30. While the AND gate 28 is maintained enabled, the enable signal E is held by a circulation circuit consisting of the AND gate 28, the OR gate 22 and the shift register 24.

The key-ON signal KON is applied through an OR gate 21 to a shift register 23 which is driven by the clock pulse 0. The output of the shift register 23 is delivered to an AND gate 27 which is controlled by a signal $\overline{KON}$ which is obtained by inverting the key-ON signal KON by an inverter 26. The output of the AND gate 27 is applied to the AND gates 29 and 31. The output of the AND gate 29 is applied through the OR gate 21 to the shift register 23.

The operation of the example described above will be described with reference to FIG. 8.

When the absolute value of the amplitude of a waveform signal read out of the waveform memory 4 upon or after depression of a key is lower than "−24 dB", the signal on the line $l_6$ and/or the signal on the line $l_7$ is raised to "1", and during this period the level detection signal LD is outputted through the OR gate 10. On the other hand, the key-ON signal applied to the circuit in FIG. 6 operates the AND gate 20 when the level detection signal LD is provided for the first time after the rise of the key-ON signal, as a result of which a signal in synchronization with the level detection signal LD is outputted by the AND gates 20 and it is applied to the shift register 24. The frequency of the clock pulse signal 0 is selected to be sufficiently high, and therefore the input signal to the shift register 24 is outputted as the enable signal E immediately after the provision of the firstly outputted level detection signal LD. During the generation of the key-ON signal, the output of the AND gate 27 is maintained "0", and therefore both of the AND gates 29 and 31 are at "0". Therefore, the output of the inverter 30 is raised to "1" to enable the AND gate 28. Thus, the enable signal E is held by the circulation circuit consisting of the AND gate 28, the OR gate 22 and the shift register 24.

Upon provision of the enable signal E, the output of the inverter 11 in FIG. 5 becomes "0". Therefore, at the time of generation of the enable signal E, that is, when the level detection signal LD is generated for the first time after the generation of the key-ON signal KON, the waveform signal together with its sign bit signal is outputted through the gates 12 to 18. However, the initial amplitude of the output waveform signal is at a small level lower than −24 dB. Therefore, no click noise is provided at the start of a musical sound.

The output of the shift register 23 is maintained "1" as long as the key-ON signal KON is generated.

When the key-ON signal KON is eliminated by releasing the key, the output of the inverter 26 is raised to "1", and the AND gate 27 is enabled. The AND gate 29 is maintained enabled after the release of the key by the output $\overline{LD}$ of the inverter 25 until the level detection signal LD is outputted. Therefore, even after the release of the key, the output of the shift register 23 is held "1" by the circulation circuit formed with the AND gates 27 and 29 and OR gate 21 until the level detection signal LD is first generated thereafter. When the level detection signal LD is produced for the first time after the elimination of the key-ON signal, a signal "1" in synchronization with the level detection signal LD is outputted by the AND gate 31. This signal is inverted into a signal "0" by the inverter 30, whereby the AND gate 28 is disabled. As a result, the circulation circuit for the shift register 24 is disconnected, and the enable signal E is decayed immediately after the level detection signal LD rises. Therefore, even if the key-ON signal KON is eliminated irrespective of the output state of the waveform signal, the enable signal E is maintained produced until the amplitude of the waveform signal becomes lower than −24 dB, that is, the enable signal E is eliminated when the amplitude becomes lower than −24 dB. Accordingly, no click noise is caused when a key is released.

In the above-described example, the waveform signal is expressed by negative logarithmic values expressed by the sign and magnitude expression method. However, a waveform signal may be expressed by linear values. If the waveform signal in either logarithmic or linear value is expressed using a so-called 2's complement expression, it is necessary that the waveform signal is once converted into a sign and magnitude expression thereby to form the above-described level detection signal LD. For this purpose, a circuit shown in FIG. 9 is provided.

Difference between the 2's complement expression method and the sign and magnitude expression method will be briefly described. In the sign and magnitude expression method, magnitudes of a waveform signal which are respectively on the positive and negative sides of its reference level and are equal in absolute value are expressed with one and same value. However, the magnitude on the positive side is given a sign "0", while the magnitude on the negative side is given a sign "1", and these values are applied as the most significant bit (MSB). In the 2's complement expression method, a value on the negative side is expressed by the complement on a value on the positive. The value on the positive side by the 2's complement expression is completely equal to the value on the positive side in the sign and magnitude expression method. However, the value on the negative side is different from the value on the negative side in the sign and magnitude expression method.

Figure 9:
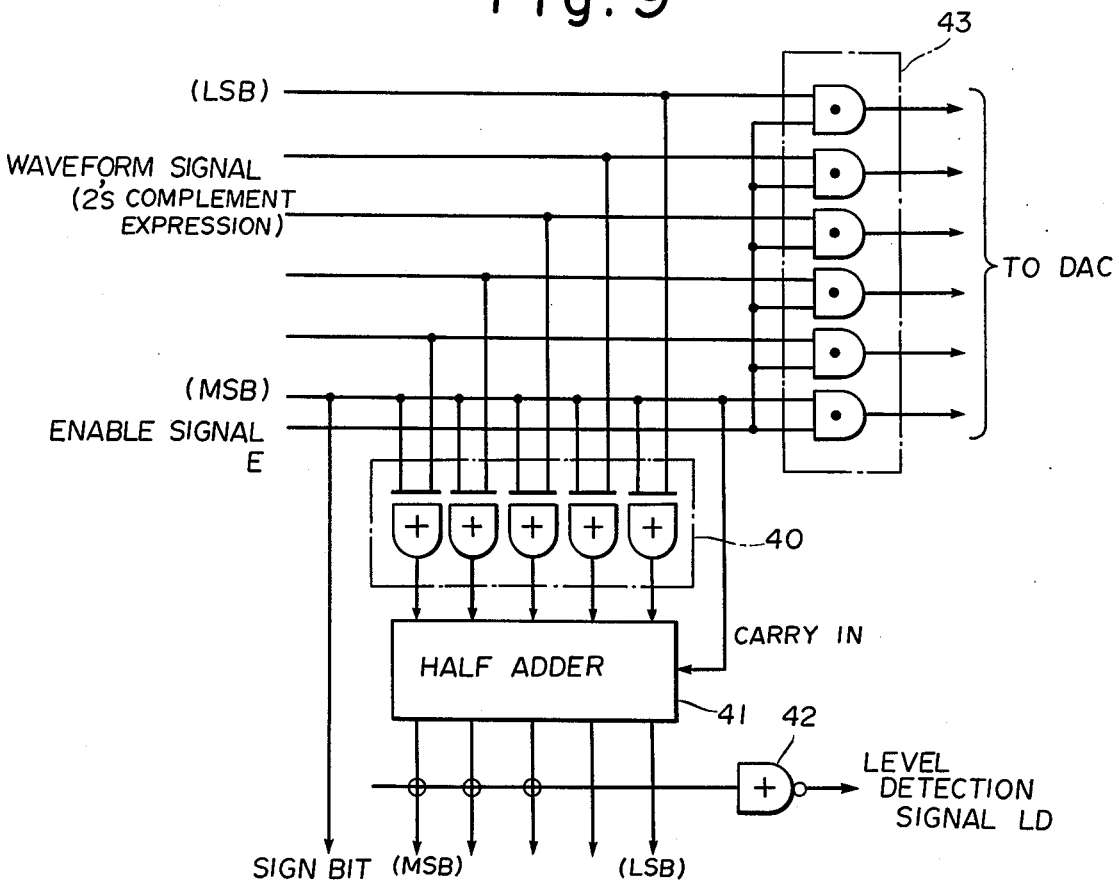
FIG. 9 is a block diagram illustrating a modification of the circuit shown in FIG. 5.

FIG. 9 shows an example of the gate circuit and the level detection signal generating circuit in which a waveform signal in linear value is expressed, using 2's complement expression, by combination of 5 value bits corresponding to different linear values. An additional bit (most significant bit) is provided to indicate the sign or polarity of the waveform signal relative to the reference level. A circuit for forming the level detection signal LD is formed with an EXCLUSIVE OR gate group 40, a half adder 41, and a NOR gate 42.

Each EXCLUSIVE OR gate receives the signal of each of the value bits and the signal of the most significant bit so that each gate outputs the signal of each value bits as it is when the most signficant bit is "0" and the inverted signal of each value bit when the most significant bit is "1". Thus, the waveform signal expressed according to the 2's complement expression method is converted into a signal according to the sign and magnitude expression method and is provided as the bit output of the half adder 41. The three higher significant bits of the output of the half adder 41 corresponding to the value bits representing relatively large values are applied to the NOR gate 42, the output of which is employed as the level detection signal LD. Therefore, when all of the three higher significant bits of the output of the half adder 41 are "0", the level detection signal "1" is outputted by the NOR gate 42. The waveform signal in 2's complement expression is applied to a digital-to-analog converter through an AND gate group 43 which is enabled by the enable signal E.

Figure 10:
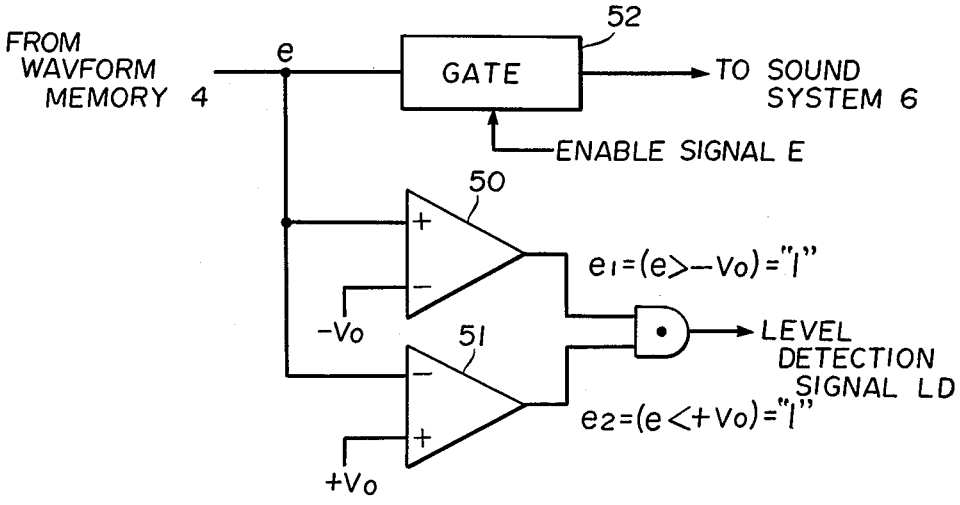
FIG. 10 is a block diagram illustrating a further modification of the circuit shown in FIG. 5.

FIG. 10 is an example of the gate circuit and the level detection signal generating circuit where the waveform signal from the waveform memory 4 is an analog signal. If the detection level range around 0 volt is from $-v_o$ volt to $+V_o$ volt, a reference signal $+V_o$ volt and a reference signal $-V_o$ volt are set in a first comparator 51 and a second comparator 50, respectively. The waveform signal is applied as a comparison signal to the first and second comparators so as to detect whether or not it is within the range of from $-V_o$ volt to $+V_o$ volt. That is, the circuit is formed so that when the amplitude of the waveform signal is within the range of $-V_o$ volt to $+V_o$ volt, the level detection signal LD is produced. The waveform signal is delivered to the sound system 6 (FIG. 4) through a gate 52 which is enabled by the enable signal E.

In the above-described examples, the waveform memory is utilized as a musical tone signal generating source. However, a musical tone signal generating circuit according to a system in which a plurality of waveform signals are simultaneously produced by using a key assigner (US Pat. No. 4,114,495 issued Sept. 19, 1978, inventor Norio Tomisawa, Assignee Nippon GAKKI Seizo K.K.), an FM system (U.S. Pat. application Ser. No. 700,941 filed on June 29, 1976, parent abandoned, continuation application Ser. No. 922,883 duly filed July 7, 1978 inventor Akiyoshi Ohya, assignee Nippon Gakki Seizo K.K.) or a partial tone synthesizing system (U.S. Pat. No. 3,821,714) may also be used. In the case where the musical tone signal generating circuit according to the partial tone synthesizing system is utilized, a method may be employed in which partial tones are subjected to synthesization to form a synthesized tone which is applied to the gate circuit according to the present invention, or a method may be employed in which the gate circuits are provided respectively for the partial tones and the partial tones which have passed through the gate circuits are subjected to synthesization.

In addition, the musical tone signal generating circuit may be replaced by a conventional analog type waveform signal generating circuit in which an oscillator, a frequency divider, etc. are employed.

Furthermore, if the technical concept of the invention is applied to an electronic musical instrument of the partial tone synthesizing system in such a manner that the gate circuits of this invention are provided respectively for partial tones, it is possible to allow the respective harmonic components in the musical tone signal to have different rise times and fall times so that a pleasant attack effect can be obtained.

In the case where an electronic musical instrument with a limited number of simultaneously produced tones is played by using a sustain pedal, if decaying production of a musical tone spans a long period of time and the relevant tone producing channel is occupied for that period, the truncate function is effected to forcibly stop the production of the musical tone to empty the channel. In this case also, as the musical tone being produced is abruptly eliminated, a click noise is caused. However, such click noise can be prevented by adding the enable signal according to the invention to the condition necessitated to effect the truncate function of the electronic musical instrument.

What is claimed is:

1. A keying system for an electronic musical instrument having a plurality of keys, each key corresponding to each musical note, comprising:

means for generating a key identification signal identifying an actuated key among said plurality of keys;

means for generating a key actuation signal representing a period of time during which the key is actuated;

a musical tone signal source for generating a musical tone signal according to said key identification signal and in response to the start of said key actuation signal;

means for detecting an amplitude at each instant of said musical tone signal to produce a detection signal each time when an absolute value of said amplitude falls within a reference range;

a gate circuit connected in a signal transmission line for transmitting said musical tone signal to a sound system, said gate circuit controlling the transmission of said musical tone signal; and a gate control circuit for rendering said gate circuit conductive in response to said detection signal after the start of said key actuation signal to transmit said musical tone signal and nonconductive in response to said detection signal after the termination of said key actuation signal to inhibit the transmission of said musical tone signal, thereby changing the condition of said gate circuit only when the absolute amplitude value of said musical tone signal is within said reference range.

2. The keying system according to claim 1, in which said gate control circuit comprises holding means H for holding said key actuation signal in response to a first one of said detection signal after the start of said key actuation signal and during the occurrence of said key actuation signal thereby to render said gate circuit conductive.

3. The keying system according to claim 1 or 2, in which said gate control circuit comprises holding means H' for holding said key actuation signal after the termination of said key actuation signal until a first one of said detection signal to thereby render said gate circuit conductive.

4. The keying system according to claim 2, in which said holding means H comprises a shift register receiving said key actuation signal, and logical gates connected to the input and output of said shift register.

5. The keying system according to claim 3, in which said holding means H' comprises a shift register receiving said key actuation signal, and logical gates connected to the input and output of said shift register.

6. The keying system according to claim 1, in which the amplitude of said musical tone signal is expressed by a combination of a plurality of bits which respectively correspond to different negative logarithmic values, and said detecting means produces said level detection signal when at least one of said bits allotted relatively large absolute value represents the allotted value.

7. The keying system according to claim 1 or 6, in which said musical tone signal source is expressed by 2's complement expression, and said detecting means comprises a converter for converting said musical tone signal into a signal comprising a plurality of bits expressed by sign and magnitude expression, and a detection circuit for detecting the contents of a predetermined bit of said musical tone signal thereby to output said level detection signal.

8. The keying system accordng to claim 1, in which said musical tone signal source outputs an analog musical tone signal, and said detecting means comprises a first comparator producing an output when the amplitude of said musical tone signal is smaller than a first reference value, a second comparator producing an output when the amplitude of said musical tone signal is larger than a second reference value, and logical gate means receiving the outputs of said first and second comparators to output said level detection signal.

* * * * *

UNITED STATES PATENT AND TRADEMARK OFFICE

CERTIFICATE OF CORRECTION

PATENT NO. : 4,182,210

DATED : January 8, 1980

INVENTOR(S) : Tetsuo Nishimoyo

It is certified that error appears in the above—identified patent and that said Letters Patent is hereby corrected as shown below:

IN THE DRAWINGS:

Sheet 3, Figure 5, "$L_1$ through $L_8$" should be -- $\ell_1$ through $\ell_8$-- respectively.

IN THE SPECIFICATION:

Column 3, line 9, "$l_1$ through $l_8$" should be -- $\ell_1$ through $\ell_8$--;

line 16, "$l_1$ to $l_7$" should be -- $\ell_1$ to $\ell_7$--;

line 18, "$l_1$" should be -- $\ell_1$--;

line 22, "$l_3$" should be -- $\ell_3$--;

line 24, "$l_1$, $l_2$ and $l_3$" should be -- $\ell_1$, $\ell_2$ and $\ell_3$--;

line 26, " $\phi_0$, $\phi_1$ ..... $\phi_{63}$" should be --$\varphi_0$, $\varphi_1$..... $\varphi_{63}$--;

UNITED STATES PATENT AND TRADEMARK OFFICE

CERTIFICATE OF CORRECTION

PATENT NO. : 4,182,210

DATED : January 8, 1980

INVENTOR(S) : Tetsuo Nishimoyo

It is certified that error appears in the above—identified patent and that said Letters Patent is hereby corrected as shown below:

line 29, " $\phi_0$ $\phi_1$ $\phi_2$ ... $\phi_{15}$ ... $\phi_{32}$ ... $\phi_{48}$ ... $\phi_{63}$" should be -- $\varphi_0$ $\varphi_1$ $\varphi_2$ ... $\varphi_{15}$ ... $\varphi_{32}$ ... $\varphi_{48}$ ... $\varphi_{63}$ --;

Column 3, line 30, "$l_1$" should be -- $\ell_1$--;

line 31, "$l_2$" should be -- $\ell_2$--;

line 32, "$l_3$" should be -- $\ell_3$--;

line 33, "$l_4$" should be -- $\ell_4$--;

line 34, "$l_5$" should be -- $\ell_5$--;

line 35, "$l_6$" should be -- $\ell_6$--;

line 36, "$l_7$" should be -- $\ell_7$--;

line 37, "$l_8$" should be -- $\ell_8$--;

line 39, "$l_8$" should be -- $\ell_8$--;

line 40, "$l_1$ through $l_8$" should be -- $\ell_1$ through $\ell_8$-- ;

UNITED STATES PATENT AND TRADEMARK OFFICE

CERTIFICATE OF CORRECTION

PATENT NO. : 4,182,210

DATED : January 8, 1980

INVENTOR(S) : Tetsuo Nishimoyo

It is certified that error appears in the above—identified patent and that said Letters Patent is hereby corrected as shown below:

line 43, "$l_8$" should be -- $\ell_8$--;

line 44, "$l_1$" should be -- $\ell_1$--;

line 45, "$l_8$" should be -- $\ell_8$--;

line 49, "$l_1$ through $l_8$" should be -- $\ell_1$ through $\ell_8$--;

Column 4, line 6, "$l_6$" should be -- $\ell_6$--;

line 7, "$l_7$" should be -- $\ell_7$--;

line 56, "$l_6$ " and "$l_7$" should be -- $\ell_6$ -- and -- $\ell_7$-- respectively.

Signed and Sealed this

*Sixteenth* Day of *September 1980*

[SEAL]

*Attest:*

SIDNEY A. DIAMOND

*Attesting Officer*

*Commissioner of Patents and Trademarks*